US007892037B2

(12) United States Patent
Kodera et al.

(10) Patent No.: US 7,892,037 B2
(45) Date of Patent: Feb. 22, 2011

(54) CONNECTOR UNIT PROVIDED WITH CONNECTOR HAVING FIRST AND SECOND CONTACTS OF DIFFERENT LENGTHS AND WITH MATING CONNECTOR HAVING FIRST AND SECOND MATING CONTACTS OF DIFFERENT LENGTHS

(75) Inventors: Masafumi Kodera, Tokyo (JP); Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/552,486

(22) Filed: Sep. 2, 2009

(65) Prior Publication Data

US 2010/0068942 A1 Mar. 18, 2010

(30) Foreign Application Priority Data

Sep. 16, 2008 (JP) ..... 2008-236999

(51) Int. Cl.
*H01R 24/00* (2006.01)

(52) U.S. Cl. ..... 439/660

(58) Field of Classification Search ..... 439/660, 439/74, 284

See application file for complete search history.

(56) References Cited

U.S. PATENT DOCUMENTS 5,181,855 A * 1/1993 Mosquera et al. ..... 439/74
5,542,851 A * 8/1996 Chikano ..... 439/108
5,618,191 A * 4/1997 Chikano et al. ..... 439/108
5,921,787 A * 7/1999 Pope et al. ..... 439/74
6,036,504 A * 3/2000 McHugh et al. ..... 439/74
6,183,315 B1 * 2/2001 McHugh et al. ..... 439/752
6,454,610 B1 * 9/2002 Yu ..... 439/660
6,540,529 B1 * 4/2003 Yu ..... 439/74
6,984,137 B2 * 1/2006 Akasaka et al. ..... 439/108
7,004,763 B2 * 2/2006 Ma ..... 439/74
7,037,117 B2 * 5/2006 Goto ..... 439/74
7,294,019 B1 * 11/2007 Jeon ..... 439/607.05
7,344,387 B2 * 3/2008 Shiroyama ..... 439/74
7,425,158 B2 * 9/2008 Ookura ..... 439/660
7,544,067 B1 * 6/2009 Hatano et al. ..... 439/84

(Continued)

FOREIGN PATENT DOCUMENTS

JP 2005-19075 A 1/2005

*Primary Examiner*—T C Patel
*Assistant Examiner*—Vladimir Imas
(74) *Attorney, Agent, or Firm*—Holtz, Holtz, Goodman & Chick, PC

(57) ABSTRACT

A connector unit which is less liable to skew and easy to be manufactured. A PC-side connector comprises first and second PC-side contacts and a PC-side housing holding the contacts. A dock-side connector comprises first and second dock-side contacts and a dock-side housing holding the contacts. An intermediate portion connecting between contact and terminal portions of each first PC-side contact and an intermediate portion connecting between contact and terminal portions of each second PC-side contact have respective crank shapes. An intermediate portion connecting between contact and terminal portions of each first dock-side contact have approximately the same shape and length as the intermediate portion of each second PC-side contact. An intermediate portion connecting between a contact portion and a terminal portion of each second dock-side contact have approximately the same shape and length as the intermediate portion of each first PC-side contact.

4 Claims, 8 Drawing Sheets

U.S. PATENT DOCUMENTS 7,591,684 B2 * 9/2009 Zhang et al. ..... 439/660
2005/0118879 A1 * 6/2005 Shimizu ..... 439/660
2006/0035526 A1 * 2/2006 Shimizu ..... 439/660
2006/0258227 A1 * 11/2006 Ookura ..... 439/660

* cited by examiner

CONNECTOR UNIT PROVIDED WITH CONNECTOR HAVING FIRST AND SECOND CONTACTS OF DIFFERENT LENGTHS AND WITH MATING CONNECTOR HAVING FIRST AND SECOND MATING CONTACTS OF DIFFERENT LENGTHS

BACKGROUND OF THE INVENTION

1. Field of the Invention

This invention relates to a connector unit, and more particularly to a connector unit which is compatible with high-speed transmission of electrical signals.

2. Description of the Related Art

Conventionally, there has been proposed a socket comprised of an insulator, upper signal terminals, lower signal terminals, earth terminals, and a metallic shell (see Japanese Laid-Open Patent Publication (Kokai) No. 2005-19075).

The upper signal terminals and the lower signal terminals are held by the insulator.

The insulator is covered by the metallic shell.

Each of the upper signal terminals and the lower signal terminals includes a contact portion, a fixing portion, and a connection portion. The fixing portion is fixed to the insulator, the contact portion which continues to one end of the fixing portion extends forward, and the connection portion which continues to the other end of the fixing portion extends backward. The connection portion is connected to a printed-wiring board.

The contact portion and the fixing portion of the upper signal terminal are located above (upward in a vertical direction of the insulator) with respect to the contact portion and the fixing portion of the lower signal terminal.

This socket is connected to a plug.

The plug is comprised of an insulator, upper signal terminals, lower signal terminals, earth terminals, and a metallic shell.

The insulator is covered by the metallic shell, and each of the upper signal terminals and the lower signal terminals includes a contact portion, a fixing portion, and a connection portion. The fixing portion is fixed to the insulator, the contact portion which continues to one end of the fixing portion extends forward, and the connection portion which continues to the other end of the fixing portion extends backward. The connection portion is connected to a cable.

When this plug is connected to the above-mentioned socket, each contact portion of the upper signal terminals, the lower signal terminals and the like of the plug is brought into contact with each contact portion of the upper signal terminals, the lower signal terminals and the like of the socket, respectively, whereby the cable and the printed-wiring board are electrically connected to each other.

In the above-described conventional connector unit, the length of an intermediate portion which connects the connection portion and the fixing portion of each upper signal terminal is formed to be equal to that of an intermediate portion which connects the connection portion and the fixing portion of each lower signal terminal so as to make a passage length (length of a passage for an electrical signal) between the connection portion of the upper signal terminal of the plug and the connection portion of the upper signal terminal of the socket equal to a passage length (length of a passage for an electrical signal) between the connection portion of the lower signal terminal of the plug and the connection portion of the lower signal terminal of the socket when the plug is connected to the socket.

However, the length in a front-rear direction of the upper signal terminal and the lower signal terminal (the front-rear direction of the insulator) have to be formed to be equal, and hence the connection portion of the lower signal terminal is partially bent.

Therefore, the processing of the lower signal terminals is troublesome, which makes it difficult to produce the socket, and causes an increase in manufacturing costs.

SUMMARY OF THE INVENTION

The present invention has been made in view of these circumstances, and an object thereof is to provide a connector unit which is less liable to skew, and is easy to be manufactured.

To attain the above object, the present invention provides a connector unit comprising a connector including a plurality of contacts and a housing that holds the contacts, the plurality of contacts being formed by first contacts, and second contacts different from the first contacts, each of the first contacts and the second contacts including a contact portion, a terminal portion which is connected to one object to be connected, and an intermediate portion which connects between the contact portion and the terminal portion; and a mating connector including a plurality of mating contacts, and a mating housing that holds the plurality of mating contacts and is fitted in the housing, the plurality of mating contacts being formed by first mating contacts, and second mating contacts different from the first mating contact, each of the first mating contacts and the second mating contacts including a mating contact portion which is brought into contact with an associated one of the contact portions of the first and second contacts, a mating terminal portion which is connected to another object to be connected, and a mating intermediate portion which connects between the mating contact portion and the mating terminal portion, the mating intermediate portion of each first mating contact having a shape and length which are approximately the same as the shape and length of the intermediate portion of each second contact, the mating intermediate portion of the each second mating contact having a shape and length which are approximately the same as the shape and length of the intermediate portion of each first contact.

With the arrangement of the connector unit according to the present invention, the intermediate portion of each first contact and the mating intermediate portion of each second mating contact are configured to have approximately the same shape and length, and the intermediate portion of each second contact and the mating intermediate portion of each first mating contact are configured to have approximately the same shape and length. Therefore, when the connector is connected to the mating connector, the passage length between the terminal portion of each first contact of the connector and the terminal portion of each first mating contact of the mating connector becomes equal to that between the terminal portion of each second contact of the connector and the terminal portion of each second mating contact of the mating connector. This makes the connector less liable to skew. Further, it is easy to manufacture the first and second contacts and the first and second mating contacts.

Preferably the respective intermediate portions of each first contact, each second contact, each first mating contact, and each second mating contact are each formed to have a crank shape.

Preferably, the connector includes a shell which covers the housing, and the mating connector includes a mating shell which covers the mating housing, and the shell includes shell-side contact portions which are brought into contact with the mating shell, and shell-side terminal portions which are connected to the other object to be connected.

According to this invention, it is possible to provide a connector unit which is less liable to skew, and is easy to be manufactured.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1A:
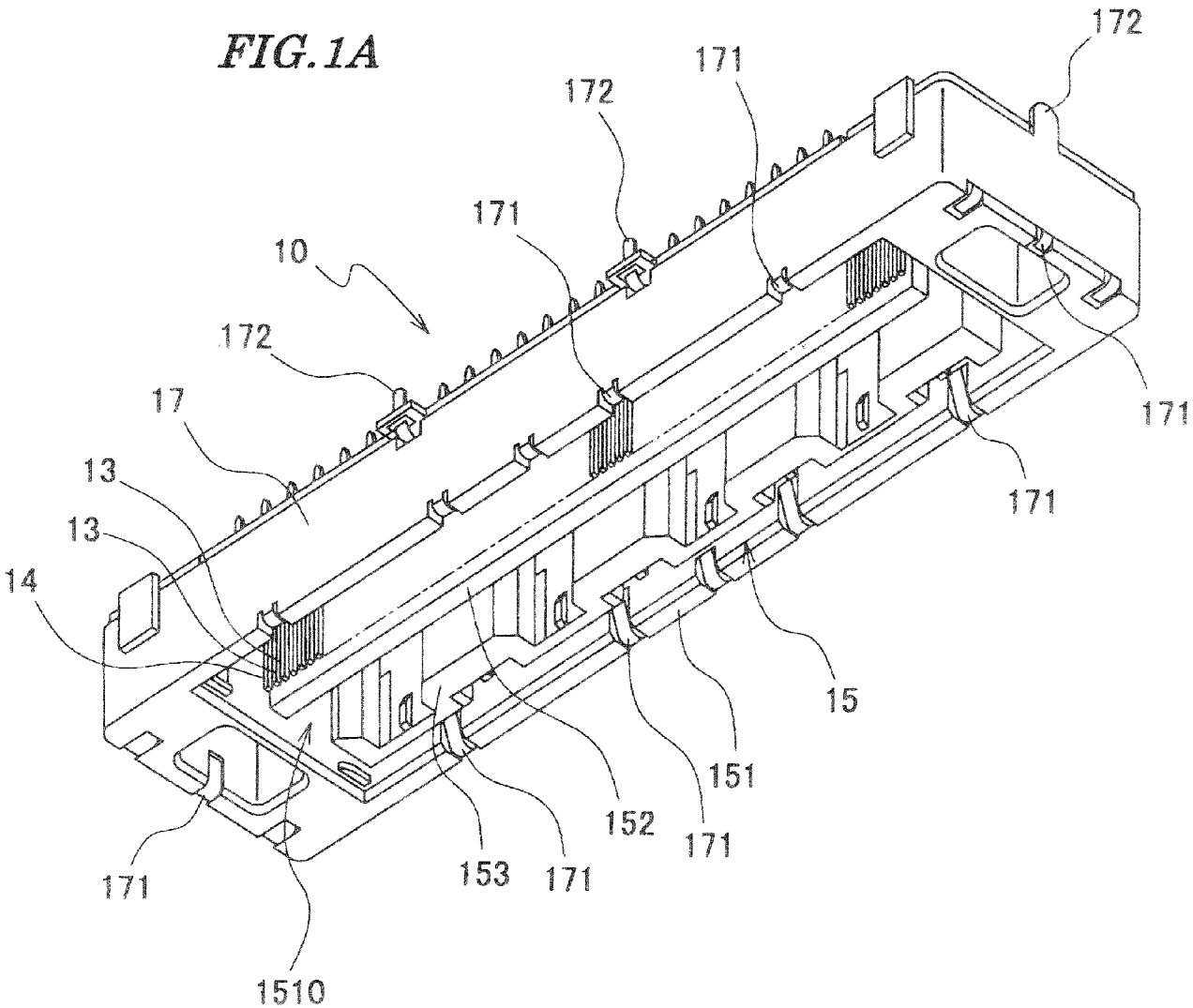
FIG. 1A is a perspective view of a PC-side connector of a connector unit according to an embodiment of the present invention.
Figure 1B:
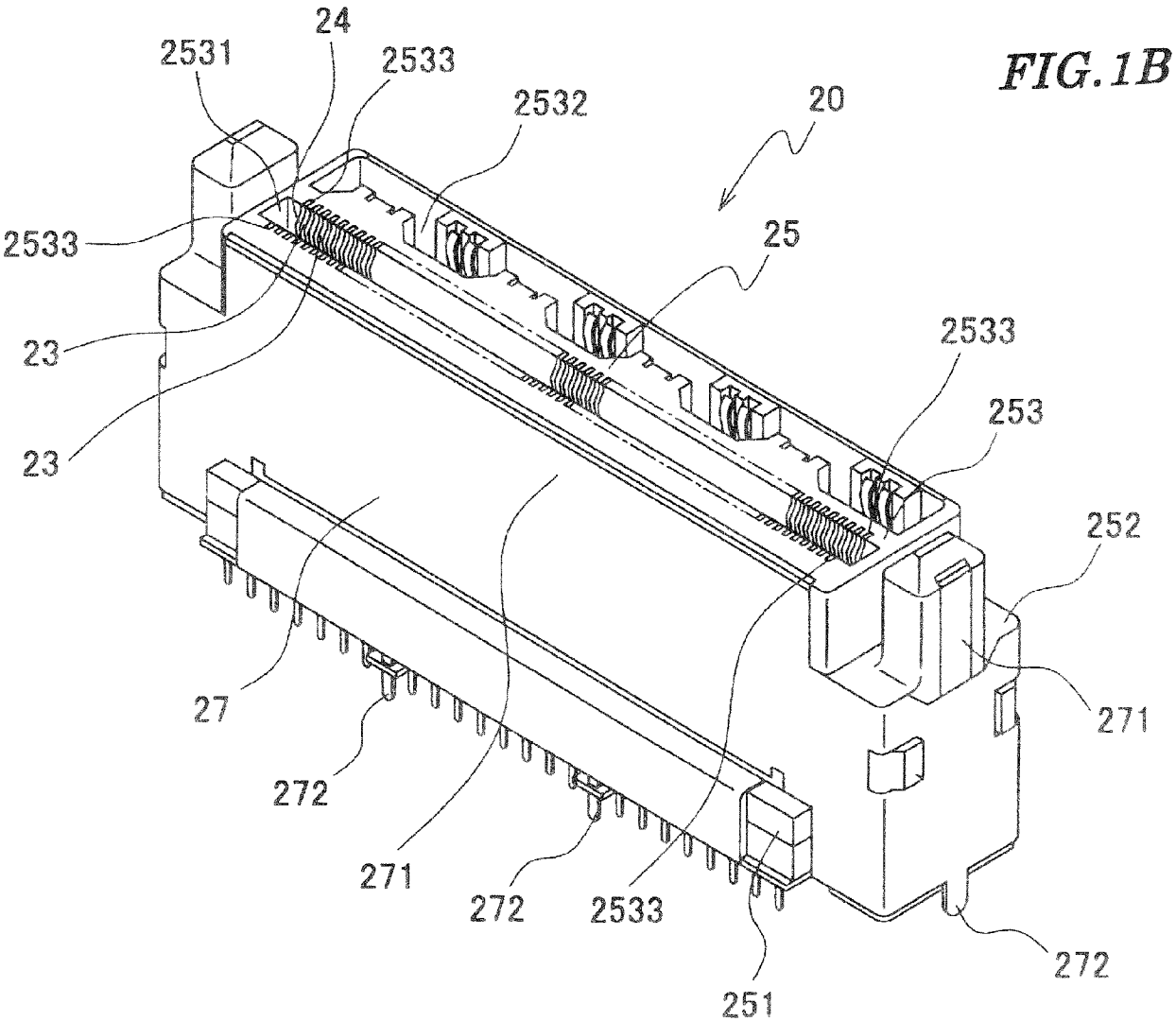
FIG. 1B is a perspective view of a dock-side connector of the connector unit according to the embodiment of the present invention.
Figure 2:
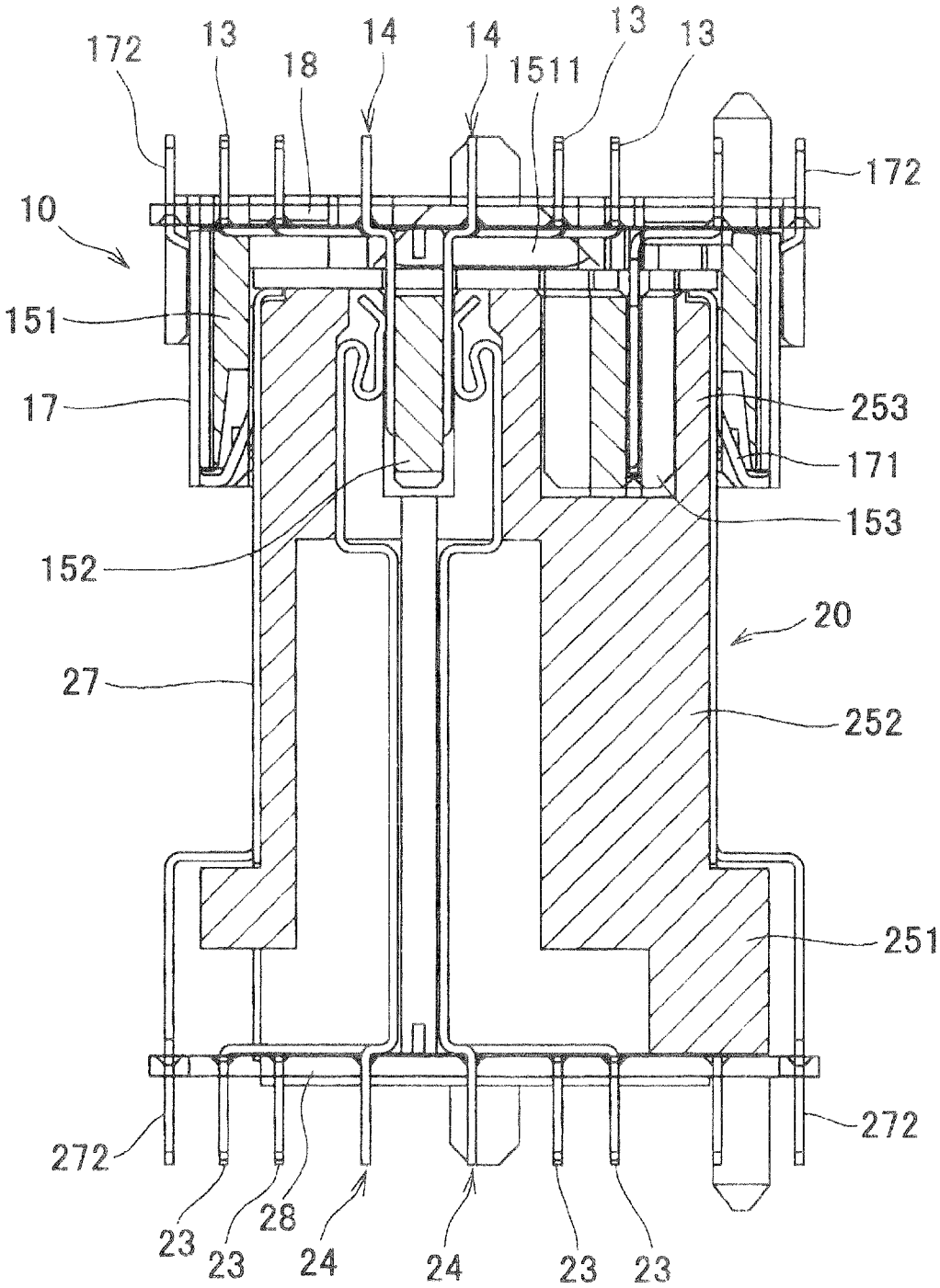
FIG. 2 is a cross-sectional view of the FIG. 1A PC-side connector and the FIG. 1B dock-side connector of the connector unit in a state in which the PC-side connector and the dock-side connector are fitted to each other.

Referring to FIGS. 1A, 1B and 2, a connector unit according to this embodiment is comprised of a PC (personal computer)-side connector (connector) 10 and a dock-side connector (mating connector) 20.

The PC-side connector 10 is mounted on a printed board in a so-called notebook PC, not shown, and a front end of the PC-side connector 10 protrudes from a casing of the notebook PC. The PC-side connector 10 is comprised of PC-side contacts (contacts) 13, PC-side ground contacts 14, and a PC-side housing (housing) 15.

The dock-side connector 20 is mounted on a printed board in a docking station, not shown, which is placed on a desk, not shown, and a front end of the dock-side connector 20 protrudes from a casing of the docking station. When the notebook PC is used on the desk, the dock-side connector 20 is connected to the PC-side connector 10 provided in the notebook PC. The dock-side connector 20 is comprised of dock-side contacts (mating contacts) 23, dock-side ground contacts 24, and a dock-side housing (mating housing) 25.

Figure 3A:
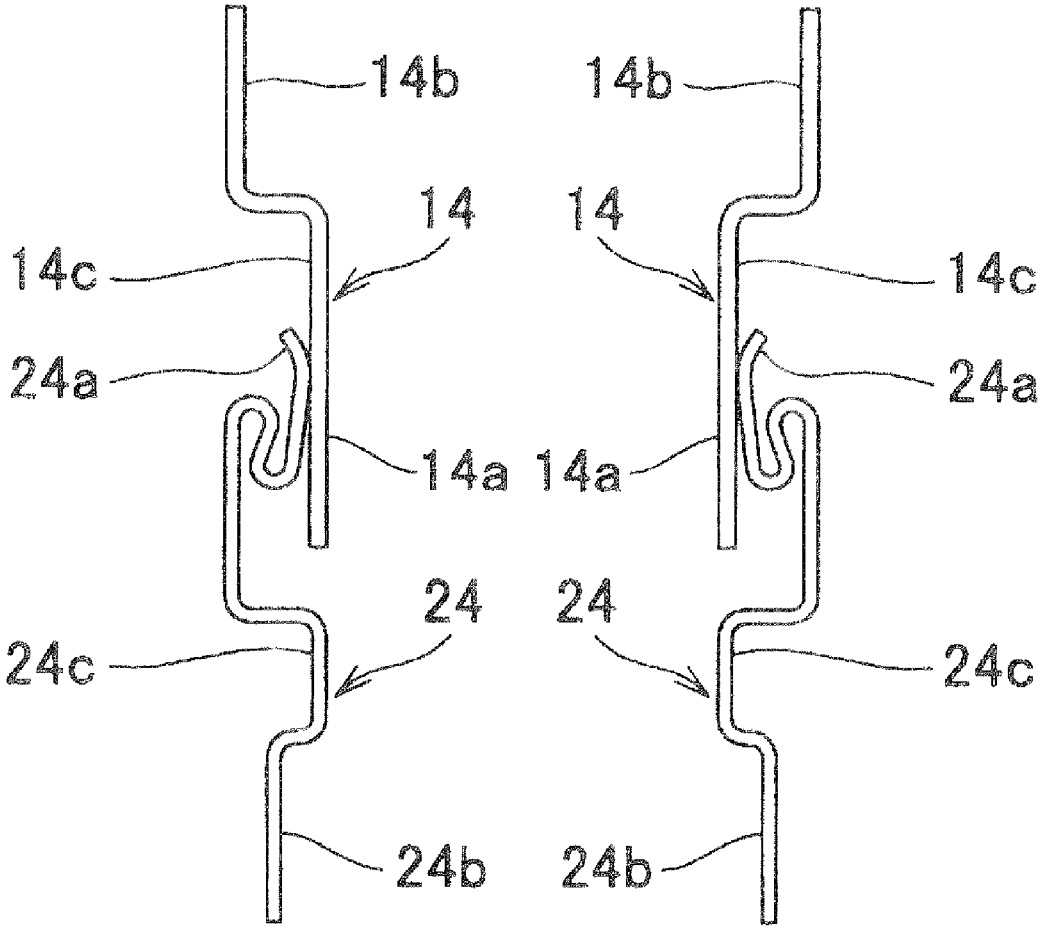
FIG. 3A is a schematic view of PC-side ground contacts of the PC-side connector and dock-side ground contacts of the dock-side connector of the FIG. 1 connector unit in a state in which the PC-side ground contacts and the dock-side ground contacts are brought into contact with each other.

Referring to FIG. 3A, each of the PC-side ground contacts 14 includes a contact portion 14*a*, a terminal portion 14*b*, and an intermediate portion 14*c*. Each PC-side ground contact 14 is formed by blanking a metal plate.

The contact portion 14*a* is at one end of each PC-side ground contact 14, and is pin-shaped.

The terminal portion 14*b* is at the other end of the PC-side ground contact 14, and is pin-shaped. The terminal portion 14*b* is inserted in an associated one of through holes of the printed board of the notebook PC and is soldered thereto.

The intermediate portion 14*c* is crank-shaped, and connects between the contact portion 14*a* and the terminal portion 14*b*.

Each of the dock-side ground contacts 24 is formed by blanking and bending a metal plate. Each dock-side ground contact 24 includes a contact portion 24*a*, a terminal portion 24*b*, and an intermediate portion 24*c*.

The contact portion 24*a* is at one end of each dock-side ground contact 24, bent into a substantial S-shape, and is brought into contact with the associated contact portion 14*a* of each PC-side ground contact 14.

The terminal portion 24*b* is at the other end of each dock-side ground contact 24 and is pin-shaped. The terminal portion 24*b* is inserted in an associated one of through holes of the printed board of the dock station and is soldered thereto.

The intermediate portion 24*c* connects between the contact portion 24*a* and the terminal portion 24*b*.

Figure 3B:
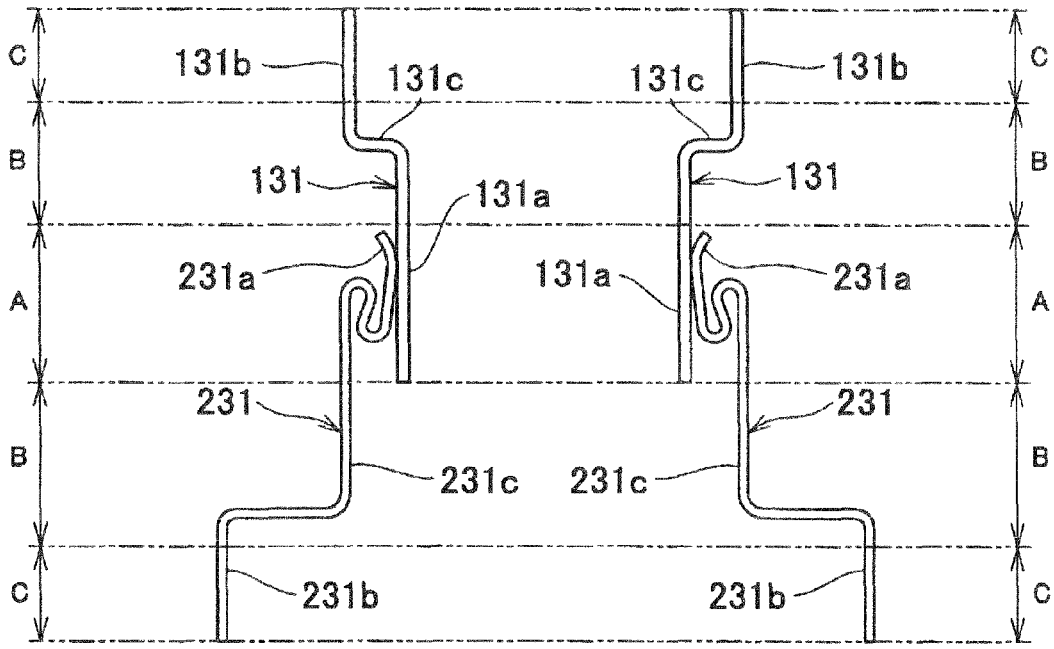
FIG. 3B is a schematic view of first PC-side contacts of the PC-side connector and first dock-side contacts of the dock-side connector of the FIG. 1 connector unit in a state in which the first PC-side contacts and the first dock-side contacts are brought into contact with each other.
Figure 3C:
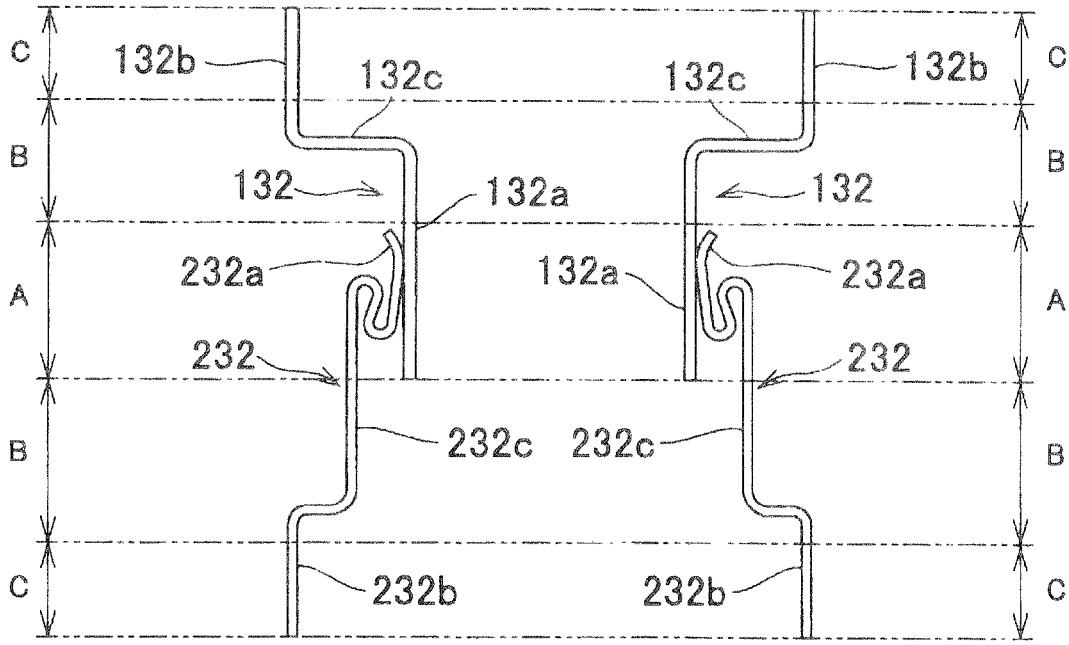
FIG. 3C is a schematic view of second PC-side contacts of the PC-side connector and second dock-side contacts of the dock-side connector of the FIG. 1 connector unit in a state in which the second PC-side contacts and the second dock-side contacts are brought into contact with each other.

Referring to FIGS. 3B and 3C, the PC-side contacts 13 include two kinds of contacts, such as first PC-side contacts (first contacts) 131, and second PC-side contacts (second contacts) 132.

Each of the first PC-side contacts 131 is formed by blanking and bending a metal plate. Each first PC-side contact 131 includes a contact portion 131*a*, a terminal portion 131*b*, and an intermediate portion 131*c*.

The contact portion 131*a* is at one end of each first PC-side contact 131, and is pin-shaped.

The terminal portion 131*b* is at the other end of each first PC-side contact 131, and is pin-shaped. The terminal portion 131*b* is inserted in an associated one of the through holes of the printed board of the notebook PC and is soldered thereto.

The intermediate portion 131*c* is bent into a substantial crank shape, and connects between the contact portion 131*a* and the terminal portion 131*b*.

Each of the second PC-side contacts 132 is formed by blanking and bending a metal plate. Each second PC-side contact 132 includes a contact portion 132*a*, a terminal portion 132*b*, and an intermediate portion 132*c*.

The contact portion 132*a* is at one end of each second PC-side contact 132, and is pin-shaped.

The terminal portion 132*b* is at the other end of each second PC-side contact 132, and is pin-shaped. The terminal portion 132*b* is inserted in an associated one of the through holes of the printed board of the notebook PC to be soldered.

The intermediate portion 132*c* is bent into a substantial crank shape, and connects between the contact portion 132*a* and the terminal portion 132*b*. The length of the intermediate portion 131*c* of each first PC-side contact 131 is different from that of the intermediate portion 132*c* of each second PC-side contact 132.

As shown in FIGS. 3B and 3C, similarly to the PC-side contacts 13, the dock-side contacts 23 include two kinds of dock-side contacts, such as first dock-side contacts (first mating contact) 231 and second dock-side contacts (second mating contact) 232.

Each of the first dock-side contacts 231 is formed by blanking and bending a metal plate. Each first dock-side contact 231 includes a contact portion 231*a*, a terminal portion 231*b*, and an intermediate portion 231*c*.

The contact portion 231*a* is at one end of each first dock-side contact 231, and is bent into a substantial S-shape. The contact portion 231*a* is brought into contact with the associated contact portion 131*a* of each first PC-side contact 131.

The terminal portion 231*b* is at the other end of each first dock-side contact 231. The terminal portion 231*b* is inserted in an associated one of the through holes of the printed board of the dock station and is soldered thereto.

The intermediate portion 231*c* is bent into a substantial crank shape, and connects the contact portion 231*a* and the terminal portion 231*b*.

Each of the second dock-side contacts 232 is formed by blanking and bending a metal plate. Each second dock-side contact 232 includes a contact portion 232*a*, a terminal portion 232*b*, and an intermediate portion 232*c*.

The contact portion 232*a* is at one end of each second dock-side contact 232, and is bent into a substantial S-shape. The contact portion 232*a* is brought into contact with the associated contact portion 132*a* of each second PC-side contact 132.

The terminal portion 232*b* is at the other end of each second dock-side contact 232. The terminal portion 232*b* is inserted in an associated one of the through holes of the printed board of the dock station to be soldered.

The intermediate portion 232*c* is bent into a substantial crank shape, and connects between the contact portion 232*a* and the terminal portion 232*b*. The length of the intermediate portion 231*c* of each first dock-side contact 231 is different from that of the intermediate portion 232*c* of each second dock-side contact 232.

As shown in FIG. 3B, the respective contact portions 131*a* and 231*a* of each first PC-side contact 131 and each first dock-side contact 231 according to the embodiment of the present invention extends in a range indicated by a symbol A, the intermediate portions 131*c* and 231*c* of the same extend in respective ranges indicated by each symbol B, and the terminal portions 131*b* and 231*b* of the same extend in respective ranges indicated by each symbol C. As shown in FIG. 3C, the respective contact portions 132*a* and 232*a* of each second PC-side contact 132 and the second dock-side contact 232 according to the embodiment of the present invention extend in the range indicated by the symbol A, the intermediate portions 132*c* and 232*c* of the same extend in the ranges indicated by the symbol B, and the terminal portions 132*b* and 232*b* of the same extend in the ranges indicated by the symbol C.

The shape and length of the intermediate portion 131*c* of each first PC-side contact 131 are approximately the same as those of the intermediate portion 232*c* of each second dock-side contact 232. Further, the shape and length of the intermediate portion 132*c* of each second PC-side contact 132 are approximately the same as those of the intermediate portion 231*c* of each first dock-side contact 231. Therefore, when the PC-side connector 10 and the dock-side connector 20 are fitted, the passage length from the terminal portion 131*b* of each first PC-side contact 131 to the terminal portion 231*b* of each first dock-side contact 231 and the passage length from the terminal portion 132*b* of each second PC-side contact 132 to the terminal portion 232*b* of each second dock-side contact 232, as shown in FIGS. 3B and 3C, becomes approximately equal to each other. It should be noted that the shape and length of the intermediate portion 131*c* of each first PC-side contact 131 may be configured to be different from those of the intermediate portion 232*c* of each second dock-side contact 232. Further, the shape and length of the intermediate portion 132*c* of each second PC-side contact 132 may be configured to be different from those of the intermediate portion 231*c* of each first dock-side contact 231. In these cases, the difference between the length of the intermediate portion 131*c* and that of the intermediate portion 132*c* is made equal to the difference between the length of the intermediate portion 231*c* and that of the intermediate portion 232*c*.

As shown in FIGS. 1A, 1B, and 2, the PC-side housing 15 of the PC-side connector 10 includes a housing body 151, a first disposition portion 152, and a second disposition portion 153.

The housing body 151 is substantially box-shaped, and includes a receiving space 1510.

The first disposition portion 152 is substantially plate-shaped, and is connected to a bottom 1511 (see FIG. 2) of the housing body 151. The longitudinal direction of the first disposition portion 152 is parallel to the longitudinal direction of the housing body 151. The respective contact portions 14*a*, 131*a*, and 132*a* of the PC-side ground contacts 14, the first PC-side contacts 131, and the second PC-side contacts 132 are arranged at equally-spaced intervals on one surface of the first disposition portion 152. The contact portions 14*a*, 131*a*, and 132*a* of the same types of the contacts 14, 131, and 132 as the three contacts 14, 131, and 132 which are arranged on one surface of the first disposition portion 152 are arranged at equally-spaced intervals on the other surface of the first disposition portion 152. It should be noted that one PC-side ground contact 14, one first PC-side contact 131, and one second PC-side contact 132 form one set of contacts, and the contact portions 14*a*, 131*a*, and 132*a* of a plurality of sets of contacts 14, 131, and 132 are arranged on the opposite surfaces of the first disposition portion 152.

The PC-side contacts 13 and the PC-side ground contacts 14 are integrally formed on the PC-side housing 15 by a so-called mold-in method. It should be noted that the contacts 13 and 14 may be configured to be held by the PC-side housing 15 by press-fitting.

A shell 17 is formed by blanking and bending a metal plate, and covers the housing body 151 of the PC-side housing 15. The shell 17 includes shell-side contact portions 171 which are connected to a mating shell 27, and shell-side terminal portions 172 which are connected to the through holes of the printed board by soldering.

Figure 4:
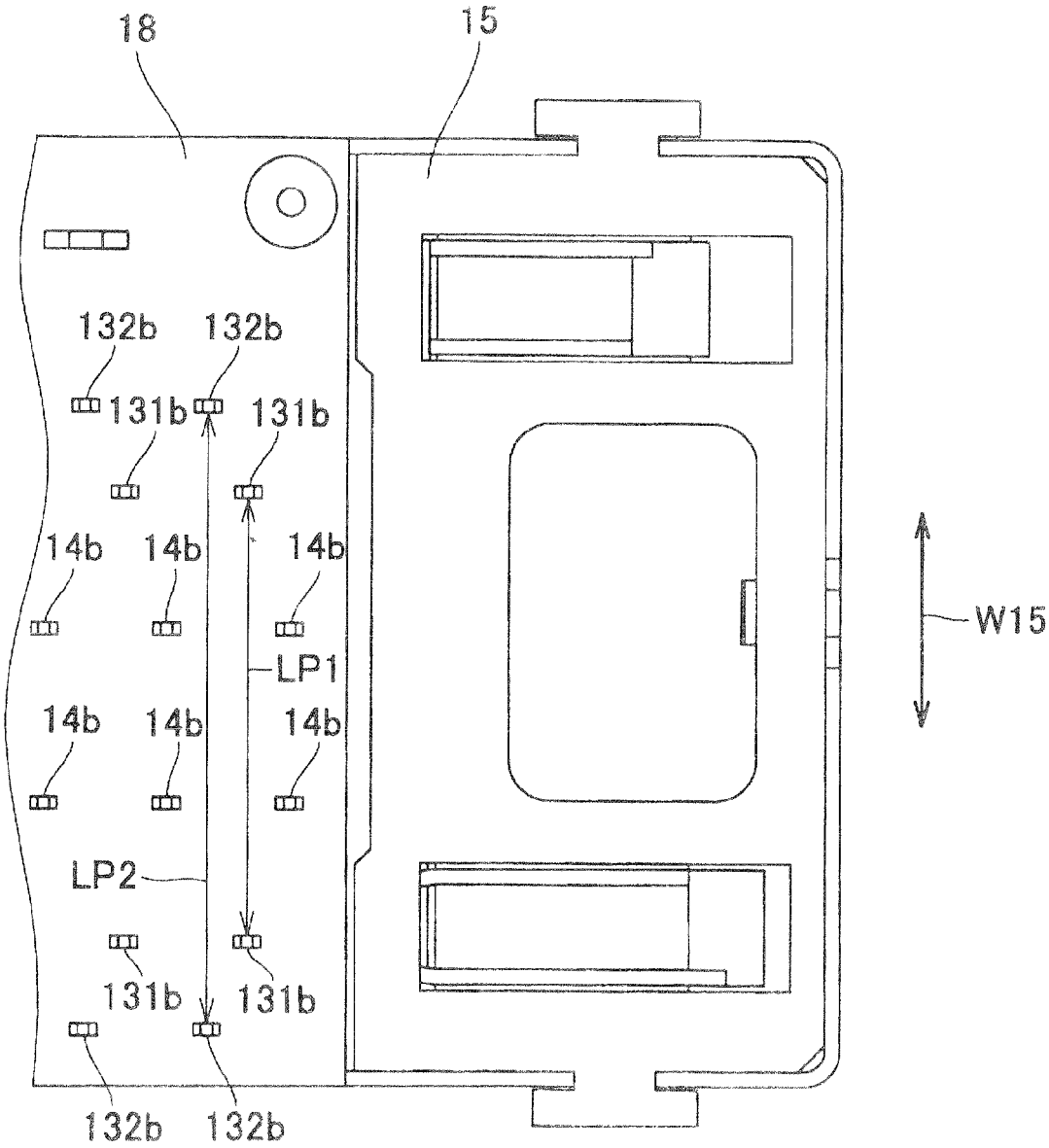
FIG. 4 is a bottom view of the PC-side connector of the FIG. 1 connector unit.

Referring to FIG. 4, the terminal portions 14*b* of the plurality of PC-side ground contacts 14 which are arranged on one surface of the first disposition portion 152, and the terminal portions 14*b* of the plurality of PC-side ground contacts 14 which are arranged on the other surface of the first disposition portion 152 are held by a locator 18 disposed on the bottom surface of the PC-side housing 15, and are arranged in two rows along the longitudinal direction of the housing 15.

The terminal portions 131*b* of the plurality of first PC-side contacts 131 which are arranged on one surface of the first disposition portion 152, and the terminal portions 131*b* of the plurality of first PC-side contacts 131 which are arranged on the other surface of the first disposition portion 152 are held by the locator 18, and are arranged in two rows along the longitudinal direction of the housing 15. Each row of the terminal portions 131*b* is located on the outer side of the corresponding row of the terminal portions 14*b*, and is located on the inner side of the corresponding row of the terminal portions 132*b*. Each row of the terminal portions 132*b* is displaced from the corresponding row of the terminal portions 131*b* by approximately half the length of spacing between each row of the terminal portions 131*b* and the corresponding row of the terminal portions 14*b* in the direction of the width W15 of the PC-side housing 15.

The terminal portions 132*b* of the plurality of second PC-side contacts 132 which are arranged on one surface of the first disposition portion 152 and the terminal portions 132*b* of the plurality of second PC-side contacts 132 which are arranged on the other surface of the first disposition portion 152 are held by the locator 18, and are arranged in two rows along the longitudinal direction of the PC-side housing 15. Each row of the terminal portions 132*b* is located on the outer side of the corresponding row of the terminal portions 131*b*, and is parallel to the row of the terminal portions 131*b*. The row of the terminal portions 132*b*, the row of the terminal portions 131*b*, and the row of the terminal portions 14*b* are displaced from one another in the longitudinal direction of the PC-side housing 15. Therefore, the terminal portions 131*b*, the terminal portions 132*b*, and the terminal portions 14*b* form so-called staggered arrangement (zigzag arrangement).

As shown in FIGS. 1A, 1B, and 2, the dock-side housing 25 of the dock-side connector 20 includes a base portion 251, a housing body 252, and a fitting portion 253.

The base portion 251 is substantially box-shaped (see FIG. 2).

The housing body 252 is continuous to an upper part of the base portion 251, and is substantially box-shaped (see FIG. 2).

The fitting portion 253 is continuous to an upper part of the housing body 252, and is inserted into the receiving space 1510 of the PC-side housing 15. The fitting portion 253 includes a first receiving space 2531, and a second receiving space 2532. The first receiving space 2531 receives the first disposition portion 152 of the PC-side housing 15. The second receiving space 2532 receives the second disposition portion 153 of the PC-side housing 15.

The first receiving space 2531 of the fitting portion 253 is formed with a plurality of contact accommodating grooves 2533 at equally-spaced intervals in two opposed inner surfaces thereof. The dock-side ground contacts 24, the first dock-side contacts 231, and the second dock-side contacts 232 are accommodated in the contact accommodating grooves 2533.

The dock-side contacts 23 and the dock-side ground contacts 24 are integrally formed on the dock-side housing 25 by the so-called mold-in method. It should be noted that the contacts 23 and 24 may be configured to be held by the dock-side housing 25 by press-fitting.

The shell 27 is formed by blanking and bending a metal plate, and covers the dock-side housing 25. The shell 27 includes mating shell contact portions 271 which are connected to the shell-side contact portions 171 of the shell 17, and mating shell terminal portions 272 which are connected to the through holes of the printed board by soldering.

Figure 5:
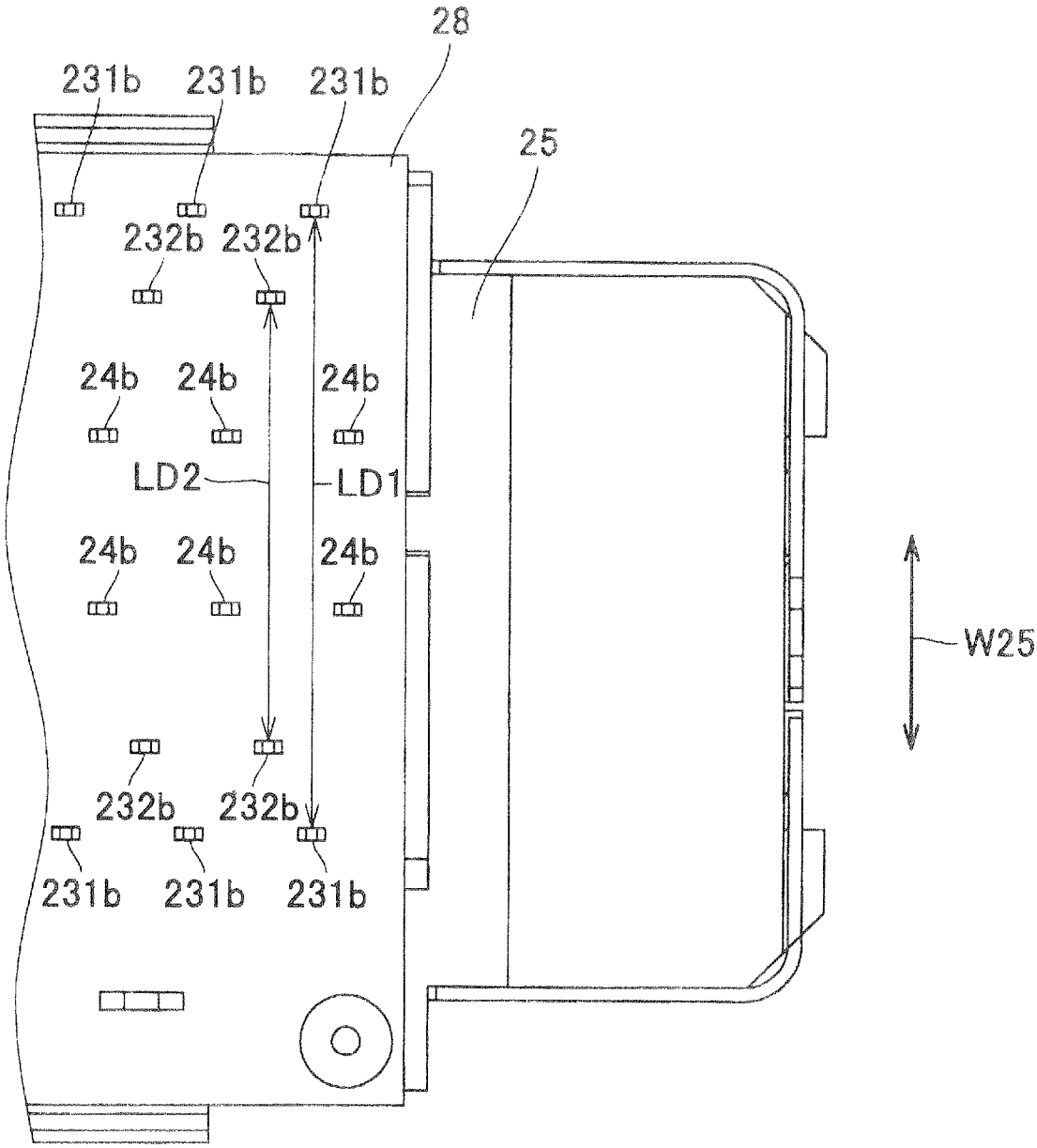
FIG. 5 is a bottom view of the dock-side connector of the FIG. 1 connector unit.

Referring to FIG. 5, the terminal portions 24*b* of the plurality of dock-side ground contacts 24 which are arranged on one inner surface of the first receiving space 2531 of the fitting portion 253, and the terminal portions 24*b* of the plurality of dock-side ground contacts 24 which are arranged on the other inner surface of the first receiving space 2531 are held by a locator 28 disposed on the bottom surface of the dock-side housing 25, and are arranged in two rows along the longitudinal direction of the dock-side housing 25.

The terminal portions 231*b* of the plurality of first dock-side contacts 231 which are arranged on one inner surface of the first receiving space 2531 of the fitting portion 253, and the terminal portions 231*b* of the plurality of first dock-side contacts 231 which are arranged on the other inner surface of the first receiving space 2531 are held by the locator 28, and are arranged in two rows along the longitudinal direction of the dock-side housing 25. Each row of the terminal portions 231*b* is located on the outer side of the corresponding row of the terminal portions 24*b*, and is parallel to the row of the terminal portions 24*b*. The row of the terminal portions 232*b* is displaced by approximately half the length of spacing between the row of the terminal portions 231*b* and the row of the terminal portions 24*b*, from the terminal portions 231*b* toward the terminal portions 24*b* in the direction W25 of the width of the dock-side housing.

The terminal portions 232*b* of the plurality of the second dock-side contacts 232 which are arranged on one inner surface of the first receiving space 2531 of the fitting portion 253, and the terminal portions 232*b* of the plurality of the second dock-side contacts 232 which are arranged on the other inner surface of the first receiving space 2531 are held by the locator 28, and are arranged in two rows along the longitudinal direction of the dock-side housing 25. Each row of the terminal portions 232*b* is located on the inner side of the corresponding row of the terminal portions 231*b*, located on the outer side of the corresponding row of the terminal portions 24*b*, and is parallel to the row of the terminal portions 231*b*. The row of the terminal portions 232*b*, the row of the terminal portions 231*b*, and the row of the terminal portions 24*b* are displaced in the longitudinal direction of the dock-side housing. Therefore, the rows of the terminal portions 231*b*, 232*b*, and 24*b* form so-called staggered arrangement (zigzag arrangement).

As shown in FIGS. 4 and 5, the distance LP1 between the terminal portions 131*b* in the direction W15 of the width of the PC-side housing 15 is approximately equal to the distance LD2 between the terminal portions 232*b* in the direction W25 of the width of the dock-side housing 25. Further, the distance LP2 between the terminal portions 132*b* in the direction W15 of the width of the PC-side housing 15 is approximately equal to the distance LD1 between the terminal portions 231*b* in the direction W25 of the width of the dock-side housing 25.

As described above, when the PC-side connector 10 and the dock-side connector 20 are fitted, since the passage length from the terminal portion 131*b* of each first PC-side contact 131 to the terminal portion 231*b* of each first dock-side contact 231 becomes approximately equal to the passage length from the terminal portion 132*b* of each second PC-side contact 132 to the terminal portion 232*b* of each second dock-side contact 232, it is possible to easily carry out impedance matching, and the connectors are less liable to skew.

Further, since all of the intermediate portions 131*c* and 132*c* of the respective first and second PC-side contacts 131 and 132, and the intermediate portions 231*c* and 232*c* of the respective first and second dock-side contacts 231 and 232 are crank-shaped, but not curved differently from the prior art, it is possible to easily form contacts, thereby making it possible to reduce the manufacturing costs of the connector.

It should be noted that although in the above-described embodiment, the PC-side connector 10 and the dock-side connector 20 include the respective shells 17, and 27, the shells 17 and 27 may not be used.

It is further understood by those skilled in the art that the foregoing are the preferred embodiments of the present invention, and that various changes and modification may be made thereto without departing from the spirit and scope thereof.

What is claimed is:

1. A connector unit comprising:

(i) a connector including a plurality of contacts, and a connector housing that holds said contacts, wherein said contacts include first contacts, and second contacts having a length that is different from said first contacts, wherein each of said first contacts and said second contacts includes a contact portion, a terminal portion which is connected to a first object to be connected, and an intermediate portion which connects between said contact portion and said terminal portion, wherein a length of said contact portions of said first contacts is approximately equal to a length of said contact portions of said second contacts, wherein a length of said terminal portions of said first contacts is approximately equal to a length of said terminal portions of said second contacts, wherein said contact portions of said first contacts and said contact portions of said second contacts are alternately arranged in two rows along a longitudinal direction of said housing, wherein said terminal portions of said first contacts are arranged in two rows along the longitudinal direction of said housing, and wherein said terminal portions of said second contacts are arranged in two rows along the longitudinal direction of said housing; and (ii) a mating connector including a plurality of mating contacts, and a mating housing that holds said plurality of mating contacts and that is fitted in said connector housing, wherein said plurality of mating contacts include first mating contacts, and second mating contacts having a length that is different from a length of said first mating contacts, wherein each of said first mating contacts and said second mating contacts includes a mating contact portion which is brought into contact with an associated one of said contact portions of said first and second contacts, a mating terminal portion which is connected to a second object to be connected, and a mating intermediate portion which connects between said mating contact portion and said mating terminal portion, wherein a length of said mating contact portions of said first mating contacts is approximately equal to a length of said mating contact portions of said second mating contacts, wherein a length of said mating terminal portions of said first mating contacts is approximately equal to a length of said mating terminal portions of said second mating contacts, wherein said mating contact portions of said first mating contacts and said mating contact portions of said second mating contacts are alternately arranged in two rows along a longitudinal direction of said mating housing, wherein said mating terminal portions of said first mating contacts are arranged in two rows along the longitudinal direction of said mating housing, wherein said mating terminal portions of said second mating contacts are arranged in two rows along the longitudinal direction of said mating housing, wherein said mating intermediate portion of each said first mating contact has a shape and a length which are approximately the same as a shape and a length of said intermediate portion of each said second contact, and wherein said mating intermediate portion of each said second mating contact has a shape and length which are approximately the same as a shape and a length of said intermediate portion of each said first contact.

2. A connector unit as claimed in claim 1, wherein the intermediate portion of each said first contact, each said second contact, each said first mating contact, and each said second mating contact has a crank shape.

3. A connector unit as claimed in claim 1, wherein said connector includes a shell which covers said connector housing, and said mating connector includes a mating shell which covers said mating housing, and wherein said shell includes shell-side contact portions which are brought into contact with said mating shell, and shell-side terminal portions which are connected to said second object to be connected.

4. A connector unit as claimed in claim 2, wherein said connector includes a shell which covers said connector housing, and said mating connector includes a mating shell which covers said mating housing, and wherein said shell includes shell-side contact portions which are brought into contact with said mating shell, and shell-side terminal portions which are connected to said second object to be connected.

* * * * *